US006446636B1

(12) United States Patent
Vittallo

(10) Patent No.: US 6,446,636 B1
(45) Date of Patent: Sep. 10, 2002

(54) METHOD OF ATTACHING SUPPLEMENTAL HAIR TO HUMAN NATURAL HAIR

(76) Inventor: Christine M. Vittallo, 29858 Abelia Rd., Canyon Country, CA (US) 91351

( * ) Notice: Subject to any disclaimer, the term of this patent is extended or adjusted under 35 U.S.C. 154(b) by 0 days.

(21) Appl. No.: 09/375,146

(22) Filed: Aug. 16, 1999

(51) Int. Cl.[7] ..... A41G 5/00
(52) U.S. Cl. ..... 132/201
(58) Field of Search ..... 132/200, 201, 132/53, 54, 55, 56

(56) References Cited

U.S. PATENT DOCUMENTS 3,596,666 A * 8/1971 Dooley ..... 132/201
3,970,092 A * 7/1976 Nelson ..... 132/201
4,934,387 A 6/1990 Megna
5,082,010 A 1/1992 Skaryd et al.
5,107,867 A 4/1992 Barrington
5,121,761 A 6/1992 Meister
5,740,819 A 4/1998 Hicks
5,868,145 A 2/1999 Spann

* cited by examiner

*Primary Examiner*—Eduardo C. Robert
(74) *Attorney, Agent, or Firm*—Michael M. Gerardi

(57) ABSTRACT

Supplemental hair is attached to human natural hair by first applying to a portion of human natural hair a bonding composition including a non-toxic non-thermoplastic resin that is soluble in an organic solvent, and a colorant, and then bonding a weft of supplemental hair to the portion of human natural hair.

17 Claims, 2 Drawing Sheets

METHOD OF ATTACHING SUPPLEMENTAL HAIR TO HUMAN NATURAL HAIR

FIELD OF THE INVENTION

The present invention relates to methods for extending and/or thickening hair, in particular human hair, and to kits including compositions and components for carrying out the inventive methods.

BACKGROUND OF THE INVENTION

Various methods for supplementing a person's natural hair in order to address problems of thinning, to provide additional length or color(s) or to otherwise change the person's appearance in a desirable manner are known. For example, U.S. Pat. No. 5,868,145, to Spann, discloses a process for attaching supplemental hair to human natural hair in which a bundle of supplemental hair is first coated with a liquid latex adhesive, which is allowed to dry, then with a liquid cyanoacrylate adhesive, which is also allowed to dry. The coated end is then aligned with strands of human natural hair to form a junction, and the junction is coated with an acrylic thermosetting adhesive, which finally is allowed to harden. This process, however, requires the use of a plurality of different adhesives, resulting in increased complexity and expense.

U.S. Pat. No. 4,934,387, to Megna, describes a method in which supplemental hair is aligned with the natural hair of the person and adhered to the natural hair using a colored thermoplastic glue. The warm adhered natural and supplemental hair are then intertwined together to permit binding of the supplemental hair to the natural hair prior to styling of the combined hair. This method, however, requires the use of a hot glue, which can cause discomfort to the person to whom the supplemental hair is provided as well as to the stylist, and also requires extensive manual manipulation of the natural and supplemental hair, thus prolonging the time required for completion of the supplementation process.

U.S. Pat. No. 5,740,819, to Hicks, teaches a method for providing supplemental hair to a person which requires stitching and braiding to secure a weft to the person's hair. This method is complicated and time consuming, and requires considerable dexterity on the part of the stylist.

A need exists for a simple, easy method of providing a person with supplemental hair. A continuing need exists for a method of hair supplementation that does not require the use of multiple adhesives or hot adhesives, and that can be performed quickly.

SUMMARY OF THE PREFERRED EMBODIMENTS

In accordance with one aspect of the present invention, there is provided a method of attaching supplemental hair to human natural hair that includes the steps of applying to a portion of human natural hair a bonding composition that includes a non-toxic non-thermoplastic (i.e., not "hot melt" type) resin that is soluble in an organic solvent, colorant, and bonding a weft of supplemental hair to the portion of human natural hair.

According to a preferred embodiment, the bonding composition includes about 0.25 wt % to 4.0 wt %, more preferably about 1.0 wt % to about 3.0 wt % of the colorant, and about, 99.75 wt % to about 96.0 wt %, more preferably about 99.0 wt % to about 97.0 wt % of the resin.

In a more specific embodiment, the resin is a polyvinyl alcohol, a polyvinylpyrrolidone, an n-$C_{1-6}$ ester of a polyvinyl alcohol, or an n-$C_{1-6}$ ether of a polyvinyl alcohol.

A more specific embodiment of the inventive method further includes the step of bonding a second portion of natural human hair to the weft, so that the weft is sandwiched between the portions of natural human hair. This preferred embodiment affords a more natural appearance and provides better concealment of the location of attachment of the weft.

Preferably, the portion of natural human hair to which the weft is to be attached is cleaned prior to application of the bonding composition.

Once the weft has been attached to the portion of human hair and has remained in position for a period of time, typically several weeks, it is beneficial to remove the weft so that it can be reattached if desired. Thus, according to another more specific embodiment, the inventive method further includes the steps of applying a bond remover composition including a solvent to the portion of natural human hair and the portion of the weft attached thereto, and removing the weft from the portion of natural human hair.

In accordance with another aspect of the present invention, there is provided a method of attaching supplemental hair to human natural hair that includes the steps of: cleaning a first portion of natural human hair; applying to the first portion of human natural hair a bonding composition including a non-toxic non-thermoplastic resin that is soluble in an organic solvent, and a colorant; bonding a weft of supplemental hair to the first portion of human natural hair; applying the bonding composition to the weft; and bonding a second portion of natural human hair to the weft, so that the weft is sandwiched between the first and second portions of natural human hair.

In accordance with still another aspect of the present invention, there is provided a kit for attaching supplemental hair to human natural hair. The kit includes, in separate containers, a bonding composition including a non-toxic non-thermoplastic resin that is soluble in an organic solvent, and a colorant, and a bond remover composition including a solvent for the bonding composition.

According to a more specific embodiment, the bond remover composition further includes a conditioning agent. Another more specific embodiment of the kit provides a bond remover composition that includes a fragrance.

According to another preferred embodiment, the kit further includes a weft.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
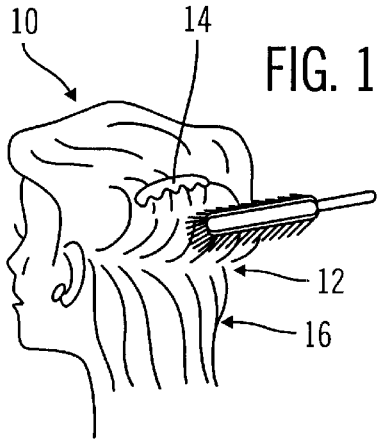
FIG. 1 is a perspective view showing the head of a representative person with her hair parted to define a portion of her natural hair which will receive the supplemental hair.

The inventive compositions and methods afford faster attachment of hair extensions to the user's natural hair, cause less damage to the user's hair than previously known compositions, and yield hair extensions that last longer before requiring replacement and are more comfortable to wear. Furthermore, the user is able to further treat his or her hair without adversely affecting the extensions or the bonds.

As used herein, "human natural hair" refers to human hair that is in place on and growing from the scalp of the person to be provided with supplemental hair. "Supplemental hair" denotes human, non-human or synthetic hair which is to be attached to the human natural hair.

Bonding compositions according to the present invention include a non-toxic non-thermoplastic resin that is soluble in an organic solvent, and a colorant. The inventive compositions are free from resins that require heating, and can be applied in a single step with minimal manipulation of the person's natural hair.

Exemplary resins useful according to the present invention include, without limitation, polyvinyl alcohols, polyvinylpyrrolidones (PVPs), n-$C_{1-6}$ esters of polyvinyl alcohols, and n-$C_{1-6}$ ethers of polyvinyl alcohols. The resins can be naturally occurring, semi-synthetic or synthetic. Combinations of two or more resins can also be used if desired. An exemplary resin mixture that is useful according to the ; invention is marketed under the name "Weld-On"® (commercially available from IPS hi Corporation, Gardena, Calif.).

Colorants afford a bonding composition that does not dry to a whitish or other undesirable color, which may be visually unappealing, but rather to a color at least approximating the person's desired hair color. Colorants useful according to the invention preferably are non-toxic and soluble in the resin(s) used to prepare the bonding composition.

| color | | ingredients |
|---|---|---|
| brown | Universal Colorant (Proline)* BPL-07 Burnt Umber | pigment brown 7<br>diethylene glycol<br>water<br>pigment yellow<br>talc |

-continued

| color | | ingredients |
|---|---|---|
| black | Universal Colorant (Proline)* BPL-02 Lampblack | talc<br>water<br>diethylene glycol<br>limestone<br>pigment black 6 |
| red | Universal Colorant (Proline)* BPL-06 Red Oxide | talc<br>water<br>diethylene glycol<br>ethylene glycol<br>pigment red 101 |
| blonde | Sandalwood 31 | |

*commercially available from Home Depot

Various hair tints can be obtained by mixing two or more colorants in appropriate proportions.

Exemplary bonding compositions include, without limitation, the following:

| | |
|---|---|
| Blonde | 2.5 oz. Blonde (Sandalwood 31, above)<br>125.5 oz Weld-On ® |
| Brown | 2 oz. Brown (Burnt Umber, above)<br>1.25 oz Black (above)<br>0.5 oz Red Oxide (above)<br>124.25 oz Weld-On ® |
| Black 1 | 2.5 oz Black (above)<br>125.5 oz Weld-On ® |
| Black 2 | 2.5 oz Black (above)<br>125.5 oz PVP |

If needed, the bonding composition can be thinned prior to application using a solvent, preferably the same solvent used in the bond remover composition discussed below. Preferred solvents are non-toxic organic solvents (i.e., applicable to the skin of a user without toxic side-effects). Exemplary solvents that can be used according to the invention include, without limitation, $C_{1-4}$ aliphatic alcohols, $C_{2-6}$ ketones and cyclic ethers having 5 to 6 carbon atoms. Specific examples of useful solvents include acetone, and, less preferably, methyl ethyl ketone.

In certain embodiments of the inventive method, the supplemental hair is removed from the person's natural hair after a length of time. To do so, a bond remover composition is employed. According to the invention, the bond remover composition includes at least one solvent for the bonding composition, and in preferred embodiments at least one conditioner and/or fragrance.

Solvents that are useful in the bond remover composition according to the invention have been set forth previously. Acetone is a particularly preferred solvent. The selected solvent can also be used to clean the hair of the person to receive the supplemental hair prior to the attachment of the supplemental hair.

Conditioning agents that are useful according to the invention enable the stylist easily to detangle the hair of the person after removal of the supplemental hair. Useful conditioning agents include, without limitation, compounds such as isolaureth-6, propylene glycol, glyceryl cocoate, and other known conditioners. When conditioning agents are included in the bond remover, they are preferably employed in amounts from about 1 to 7 wt %, based on the total weight of the bond remover composition.

If a fragrance is used, preferred amounts range from about 0.01 to 0.5 oz. per 8 oz. of bond remover composition.

An exemplary bond remover composition includes: 7.5 oz acetone; 0.25 oz conditioning agent (propylene glycol); and 0.25 tsp (0.06 oz) fragrance.

Additional diluents, such as deionized water, can also be included in the bond remover composition if desired.

Turning now to the figures, in FIG. 1 the natural hair 10 of a person is parted, for example by brushing. The natural hair can be parted in any desired manner depending on the location and orientation desired for the supplemental hair to be provided to the individual. In the preferred embodiment illustrated in FIG. 1, a horizontal part 12 is defined extending substantially along and across the occipital bone of the person. First portion 16 of the person's natural hair extends below horizontal part 12 as shown. The natural hair above the horizontal part 12 can be secured by a hair clip 14 or other securing device in order to allow the stylist unobstructed access to the first portion 16 of natural hair to which the supplemental hair is to be attached.

Figure 2:
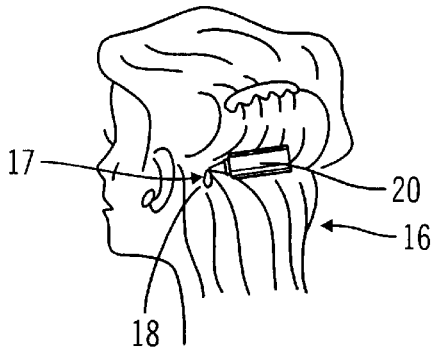
FIG. 2 is a perspective view showing application of a bonding composition to a base section of the portion of natural hair adjacent the scalp.

Next (see FIG. 2), a bonding composition 17 according to the invention is applied to the base portion 18 of first portion 16 of the person's natural hair, preferably using an applicator 20 as shown. Preferably, the bonding composition is first shaken to evenly distribute the ingredients therein, then dispensed from the applicator in an approximately horizontal orientation, in order to afford the stylist a higher degree of control of the flowrate of the bonding composition from the applicator. The bonding composition preferably is tinted to match the person's desired hair color. The bonding composition preferably is allowed to dry under a hand-held dryer for approximately 5–10 seconds to afford optimal adhesion.

Figure 3:
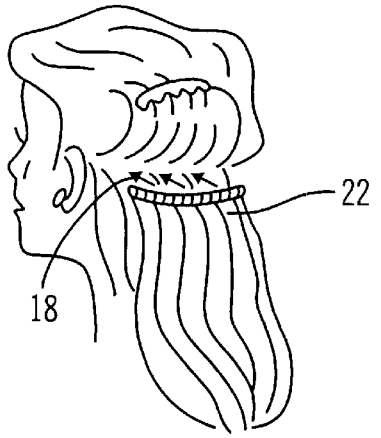
FIG. 3 is a perspective view showing application of a weft to the portion of natural hair to which the bonding composition has been applied.

In FIG. 3, a weft 22 is next pressed to the base portion 18 to which the bonding composition has been applied. Optionally, the bonding composition can also be applied to the weft as well, and dried approximately 5–10 seconds before contacting the person's hair.

The illustrated weft extends substantially entirely across the occipital portion of the person's head; however, the weft can be of any size desired by the person to whom it is provided. The weft can be formed in any desired configuration by any known method, such as weaving or the like, and can be made from natural human hair, non-human hair, synthetic hair, or any combination thereof. As with the bonding composition, the color of the weft, in preferred embodiments, matches the color of the person's natural hair. However, other colors or combinations of colors can be used to achieve particular desired styling effects, such as streaks.

The weft is held in place and smoothed until it adheres, then preferably blow-dried approximately 30 seconds.

Figure 4:
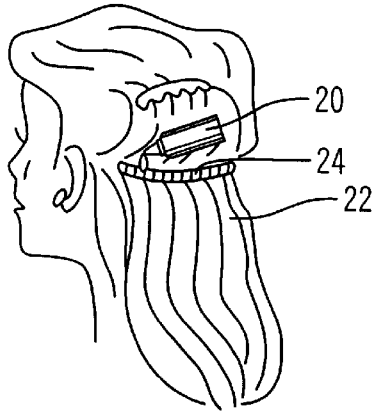
FIG. 4 is perspective view showing application of the bonding composition to the upper base portion of the weft.
Figure 5:
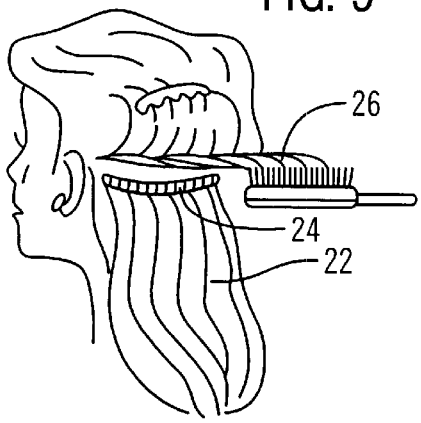
FIG. 5 is a perspective view showing a second portion of the person's natural hair being defined for attachment to the upper base portion of the weft, in order to sandwich the weft between the first and second portions of the person's natural hair.

Once weft 22 has been pressed into place, in preferred embodiments of the 25 inventive method a sandwich structure is formed in order to further conceal the line of attachment of the weft. Thus, in FIG. 4, additional bonding composition is applied to the top 24 of weft 22, again preferably using an applicator in a substantially horizontal orientation. Next (FIG. 5) a second portion 26 of natural human hair is defined from the person's hair above the weft 22 by brushing, 30 combing, picking etc. The second portion 26 is then pressed onto the weft, smoothed, and blow-dried approximately 30 seconds until bonding is achieved. The second portion 26 can be pressed onto the weft all at once, or more preferably section by section.

Figure 6:
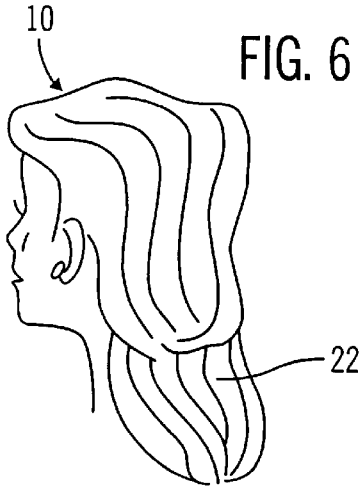
FIG. 6 is a perspective view showing the person's hair with the weft secured in place.
Figure 7:
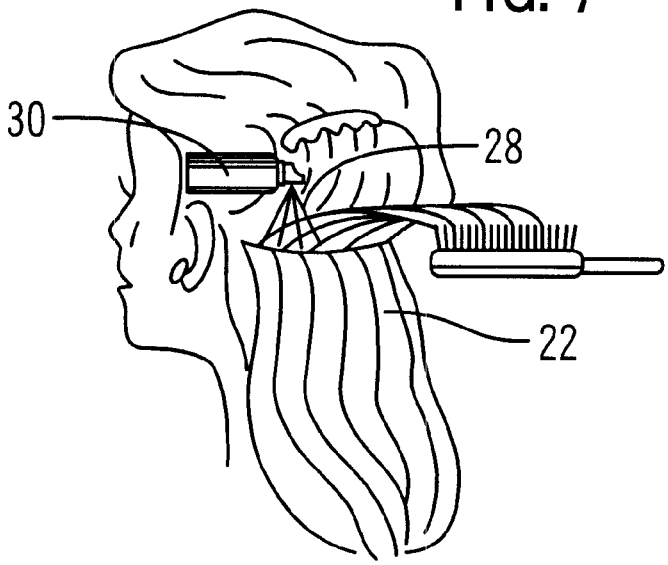
FIG. 7 is a perspective view showing application of a bond remover composition to the junction of the weft and the person's natural hair to facilitate removal of the weft.

A structure is thus formed in which first portion 16 and second portion 26 sandwich weft 18 between them. Finally, as shown in FIG. 6, the hair clip 14 or other securing device is removed from the person's hair, and her remaining hair is freed to extend downward over the upper portion of the weft. The person's hair can now be brushed and further styled as desired, and preferably dried under a warm dryer for about 10 minutes to set.

The inventive method described above is performed "on scalp", that is, the weft is secured to the human natural hair immediately adjacent and substantially in contact with the scalp. Alternatively, the method can be carried opt "off scalp", that is, the weft can be attached to the human natural hair at a distance typically up to 1.0 inch, preferably up to 0.5 inch, more preferably up to 0.25 inch depending on the needs of the person, from the scalp. The "off scalp" alternative method typically affords attachments with a shorter useful life than the "on scalp" method, but is appropriate for clients who are sensitive to the bonding compositions, or in cases in which the supplemental hair is intended to be used for a relatively short time (such as 1–2 weeks).

Optionally, an additional small portion of hair at either end of the weft can be pulled back and diagonally over the weft, bonded, dried and smoothed over the weft. This helps to maintain the supplemental hair properly located in a flat orientation.

Once the weft has been secured in place for a length of time (up to several weeks or longer) and it is desired to remove or reattach the weft, embodiments of the inventive methods further include weft removal steps. To remove the weft, the person's hair is again parted to expose the junction of the weft and the person's hair, or the sandwich structure if such was previously formed. A bond remover composition 28 including a solvent is applied, preferably by spraying from a spray applicator 30, to the bond composition. After about 3–5 seconds, the bond composition then begins to dissolve, at which point the weft can be detached from the person's hair, either manually or by use of a comb, pick or other device. The bond remover composition, in a preferred embodiment, further includes at least one conditioning agent, which facilitates detangling of the person's hair after the weft has been removed. The person's hair can then be brushed or combed to remove any residual bonding composition, and subsequently cleaned before reattachment of the weft.

Figure 8:
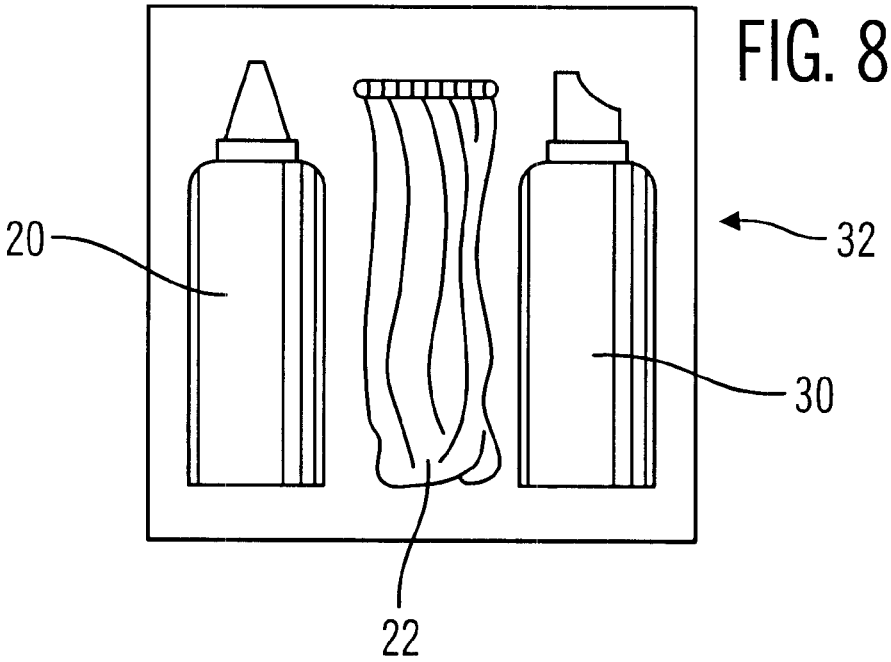
FIG. 8 is a schematic view of a kit according to an embodiment of the invention, including separately packaged bonding composition and solvent.

Kits according to the invention preferably include separately packaged bond composition and solvent. As shown in the embodiment of FIG. 8, kit 32 includes the bond composition 17, provided in an applicator 20, such as a squirt bottle, and the solvent 28 provided in a spray applicator 30, such as a pump or aerosol spray. Other packaging configurations will be readily apparent to the skilled artisan. One or more wefts 22 can also be included in the kit if desired.

Although the invention has been described with reference to human clients, the inventive methods and kits are readily applicable to animals such as dogs, horses, etc. as well. In such cases the supplemental hair will be applied to the animal's natural hair rather than to human natural hair.

What is claimed is:

1. A method of attaching supplemental hair to human natural hair, the method comprising the steps of:

a) applying to a portion of human natural hair a bonding composition comprising i) a non-toxic non-thermoplastic resin that is soluble in an organic solvent, and ii) a colorant, and iii) a fragrance composition and b) bonding a weft of supplemental hair to the portion of human natural hair.

2. The method of claim 1 wherein the bonding composition comprises about 0.25 wt % to about 4.0 wt % of the colorant and about 99.75 wt % to about 96.0 wt % of the resin.

3. The method of claim 1 wherein the resin is selected from the group consisting of polyvinyl alcohols, polyvinylpyrrolidones, n-$C_{1-6}$ esters of polyvinyl alcohols, and n-$C_{1-6}$ ethers of polyvinyl alcohols.

4. The method of claim 1 further comprising the step c) of bonding a second portion of natural human hair to the weft, wherein the weft is sandwiched between the portions of natural human hair.

5. The method of claim 1 wherein the portion of natural human hair is cleaned prior to step a).

6. The method of claim 1 further comprising the steps of applying a bond remover composition comprising a solvent to the portion of natural human hair and the portion of the weft attached thereto, and removing the weft from the portion of natural human hair.

7. A method of attaching supplemental hair to human natural hair, the method comprising the steps of:

a) cleaning a first portion of natural human hair, b) applying to the first portion of human natural hair a bonding composition comprising i) a non-toxic non-thermoplastic resin that is soluble in an organic solvent, and ii) a colorant, c) bonding a weft of supplemental hair to the first portion of human natural hair, d) applying the bonding composition to the weft, and e) bonding a second portion of natural human hair to the weft, whereby the weft is sandwiched between the first and second portions of natural human hair.

8. The method of claim 7 further comprising the steps of applying a solvent to the first and second portions of natural human hair and the portion of the weft sandwiched therebetween, and removing the weft from the first and second portions of natural human hair.

9. The method of claim 7 wherein the bonding composition comprises about 0.25 wt % to about 4.0 wt % of the colorant and about 99.75 wt % to about 96.0 wt % of the resin.

10. The method of claim 7 wherein the resin is selected from the group consisting of polyvinyl alcohols, polyvinylpyrrolidones, n-$C_{1-6}$ esters of polyvinyl alcohols, and n-$C_{1-6}$ ethers of polyvinyl alcohols.

11. The method of claim 7 wherein the bonding composition further comprises a fragrance.

12. A method of attaching supplemental hair to human natural hair, the method comprising the steps of:

a) applying to a portion of human natural hair a bonding composition comprising i) a non-toxic non-thermoplastic resin that is soluble in an organic solvent, and ii) a colorant, b) bonding a weft of supplemental hair to the portion of human natural hair, and c) bonding a second portion of natural human hair to the weft, wherein the weft is sandwiched between the portions of natural human hair.

13. The method of claim 12 wherein the bonding composition comprises about 0.25 wt % to about 4.0 wt % of the colorant and about 99.75 wt % to about 96.0 wt % of the resin.

14. The method of claim 12 wherein the resin is selected from the group consisting of polyvinyl alcohols, polyvinylpyrrolidones, n-$C_{1-6}$ esters of polyvinyl alcohols, and n-$C_{1-6}$ ethers of polyvinyl alcohols.

15. The method of claim 12 wherein the bonding composition further comprises a fragrance.

16. The method of claim 12 wherein the portion of natural human hair is cleaned prior to step a).

17. The method of claim 12 further comprising the steps of applying a bond remover composition comprising a solvent to the portion of natural human hair and the portion of the weft attached thereto, and removing the weft from the portion of natural human hair.

* * * * *